US009318310B2

(12) United States Patent
Guna

(10) Patent No.: US 9,318,310 B2
(45) Date of Patent: Apr. 19, 2016

(54) METHOD TO CONTROL SPACE CHARGE IN A MASS SPECTROMETER

(75) Inventor: Mircea Guna, North York (CA)

(73) Assignee: DH Technologies Development Pte. Ltd., Singapore (SG)

( * ) Notice: Subject to any disclaimer, the term of this patent is extended or adjusted under 35 U.S.C. 154(b) by 100 days.

(21) Appl. No.: 14/131,972

(22) PCT Filed: Jul. 11, 2012

(86) PCT No.: PCT/IB2012/001366
§ 371 (c)(1),
(2), (4) Date: Jan. 10, 2014

(87) PCT Pub. No.: WO2013/008086
PCT Pub. Date: Jan. 17, 2013

(65) Prior Publication Data

US 2014/0131569 A1 May 15, 2014

Related U.S. Application Data

(60) Provisional application No. 61/506,399, filed on Jul. 11, 2011.

(51) Int. Cl.
*H01J 49/42* (2006.01)
*H01J 49/00* (2006.01)

(52) U.S. Cl.
CPC ..... *H01J 49/4265* (2013.01); *H01J 49/004* (2013.01); *H01J 49/422* (2013.01); *H01J 49/427* (2013.01)

(58) Field of Classification Search
CPC ... H01J 49/004; H01J 49/4265; H01J 49/422; H01J 49/4225; H01J 49/424
See application file for complete search history.

(56) References Cited

U.S. PATENT DOCUMENTS

| | | | | |
|---|---|---|---|---|
| 4,818,869 | A | 4/1989 | Weber-Grabau | |
| 5,420,425 | A | 5/1995 | Bier et al. | |
| 5,479,012 | A | 12/1995 | Wells | |
| 6,177,668 | B1 | 1/2001 | Hager | |
| 6,909,089 | B2 | 6/2005 | Londry et al. | |
| 7,199,361 | B2 | 4/2007 | Bloomfield et al. | |
| 8,022,363 | B2 * | 9/2011 | Iwamoto | H01J 49/164 250/281 |
| 8,481,921 | B2 * | 7/2013 | Green | H01J 49/004 250/281 |
| 8,975,575 | B2 * | 3/2015 | Sekiya | H01J 49/0481 250/281 |
| 2004/0042415 | A1 | 3/2004 | Melville et al. | |

(Continued)

OTHER PUBLICATIONS

International Search Report for PCT/IB2012/001366, mailed Jan. 17, 2013.

(Continued)

*Primary Examiner* — Jack Berman

(57) ABSTRACT

A method for operating a mass spectrometer having an ion trap over a plurality of selected mass-to-charge ranges constituting an overall mass-to-charge range is disclosed. For each of the plurality of selected mass-to-charge ranges the method comprises filling the ion trap with fragmented ions of the selected mass-to-charge ranges, cooling the fragmented ions trapped in the ion trap for a first cooling period, applying an RF voltage and a resolving direct current voltage to the ion trap for eliminating any remaining fragmented ions outside the selected ion mass-to-charge range and retaining ions within the selected ion mass-to-charge range, cooling the retained ions in the ion trap for a second cooling period, and scanning the retained ions out of the ion trap and detecting the ions released therefrom.

8 Claims, 4 Drawing Sheets

(56) References Cited

U.S. PATENT DOCUMENTS

2007/0273385 A1 11/2007 Makarov et al.
2009/0314935 A1 12/2009 Hoyes

OTHER PUBLICATIONS

International Preliminary Report on Patentability for PCT/IB2012/001366, mailed Jan. 14, 2014.

* cited by examiner

Fill time 1ms.
Larger m/z are
present in the trap.

Fill time 1ms.
Larger m/z ions
are not present
in the trap.

Fill time 10ms.
Larger m/z ions
are present in
the trap. Mass
shift observed
was 0.020Da Fill time 10ms.
Larger m/z ions
are not present in
the trap. Mass
shift observed was
0.005Da.
Intensity, cps
m/z, Da

METHOD TO CONTROL SPACE CHARGE IN A MASS SPECTROMETER

RELATED APPLICATION

This application claims priority to U.S. provisional application No. 61/506,399 filed Jul. 11, 2011, which is incorporated herein by reference in its entirety.

FIELD

The applicant's teachings relate to mass spectrometry. More particularly, the teachings relate to linear ion traps in mass spectrometers.

INTRODUCTION

Ion traps, such as those employed in mass spectrometers, are widely used in analytical techniques. These ion traps contain multiple electrodes, surrounding a small region of space, in which ions are confined. The voltages applied to the electrodes create an electric potential-well within the ion-confinement region. Ions which move into this potential well become "trapped," i.e. restricted in motion to the ion-confinement region.

During their retention in the trap, a collection of ionized molecules can be subjected to various operations. The ions can then be ejected from the trap and a mass spectrum of the collection of ions can be obtained. The spectrum reveals information about the composition of the ions.

One issue that is common to all ion trapping systems is excess space charge, resulting from relative overfilling of the ion trap, and the interference that is exhibited as a result of space charge, whereby the mass spectrum obtained from the trapped ions becomes distorted. Such distortion can be particularly pronounced in some trap scan techniques.

Therefore, there exists a need to provide a method of reducing space charge effects.

SUMMARY

In accordance with an aspect of the applicants' teachings, there is provided a method for operating a mass spectrometer for a plurality of selected mass-to-charge ranges, the mass spectrometer having an ion trap, the plurality of selected mass-to-charge ranges constituting an overall mass-to-charge range, for each of the plurality of selected mass-to-charge ranges the method comprising:

filling the ion trap with fragmented ions of the selected mass-to-charge ranges;

cooling the fragmented ions trapped in the ion trap for a first cooling period;

applying an RF voltage and a resolving direct current voltage to the ion trap for eliminating any remaining fragmented ions outside the selected ion mass-to-charge range and retaining ions within the selected ion mass-to-charge range;

cooling the retained ions in the ion trap for a second cooling period; and scanning the retained ions out of the ion trap and detecting the ions released therefrom.

These and other features of the applicants' teachings are set forth herein.

BRIEF DESCRIPTION OF THE DRAWINGS

The skilled person in the art will understand that the drawings, described below, are for illustration purposes only. The drawings are not intended to limit the scope of the applicants' teachings in anyway.

In the drawings, like reference numerals indicate like parts.

DESCRIPTION OF VARIOUS EMBODIMENTS

Figure 1:
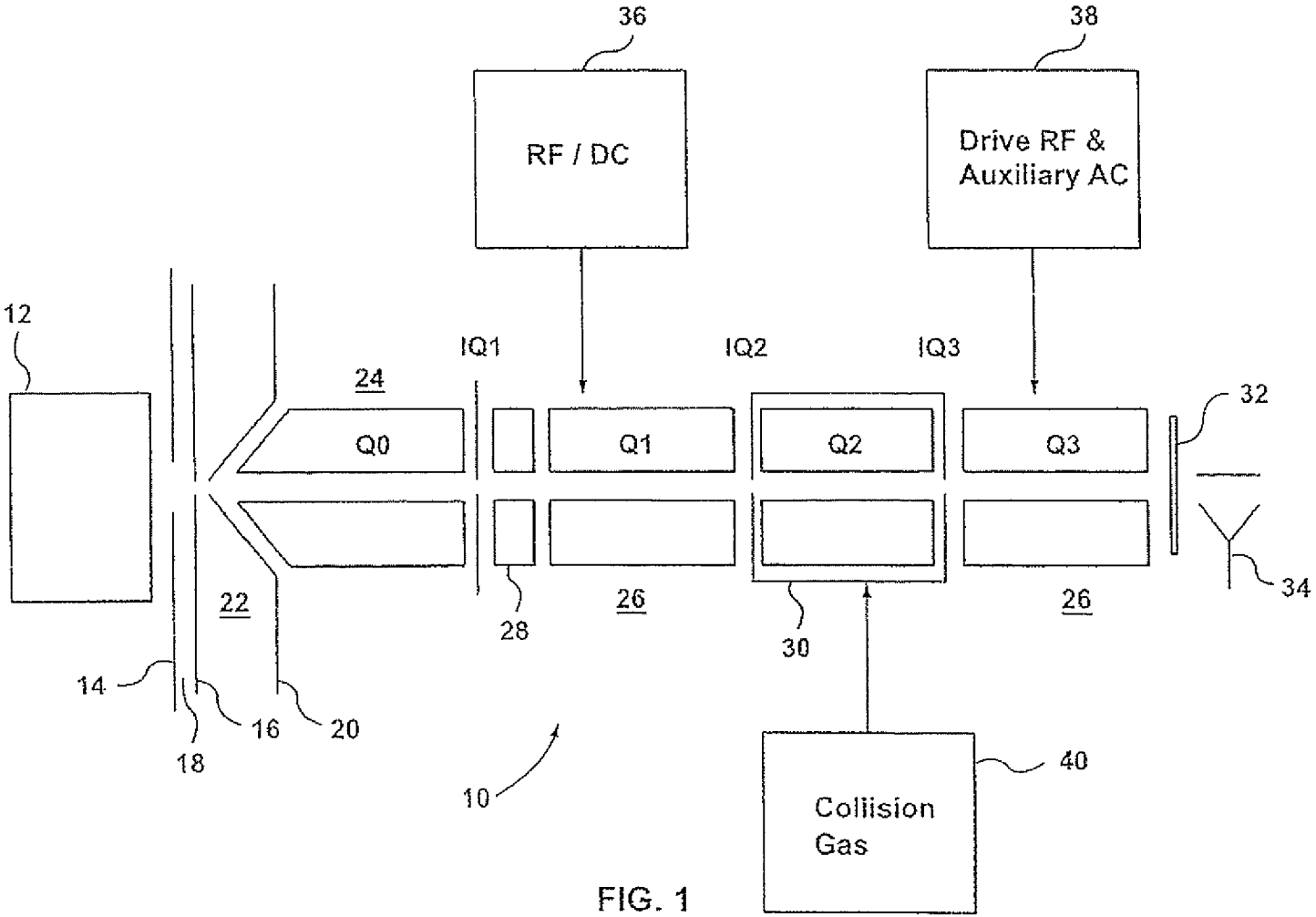
FIG. 1 schematically illustrates a conventional triple quadrupole mass spectrometer.

Turning now to FIG. 1, which schematically illustrates a conventional triple quadrupole mass spectrometer generally referenced by the numeral 10. An ion source 12, such as an electrospray ion source, generates ions directed towards a curtain plate 14. The ions then pass through an opening in an orifice plate 16. A curtain chamber 18 is formed between the curtain plate 14 and the orifice plate 16, and a flow of curtain gas reduces the flow of unwanted neutrals into the analyzing sections of the mass spectrometer.

Following the orifice plate 16, there is a skimmer plate 20. An intermediate pressure chamber 22 is defined between the orifice plate 16 and the skimmer plate 20 and the pressure in this chamber is typically of the order of 2 Torr.

ions pass through the skimmer plate 20 into the first chamber of the mass spectrometer, indicated at 24. A quadruple rod set Q0 is provided in this chamber 24, for collecting and focusing ions. This chamber 24 serves to extract further remains of the solvent from the ion stream, and typically operates under a pressure of 7 mTorr. It provides an interface into the analyzing sections of the mass spectrometer.

A first interquad barrier or lens IQ1 separates the chamber 24 from the main mass spectrometer chamber 26 and has an aperture for ions. Adjacent the interquad barrier IQ1, there is a short "stubbies" rod set, or Brubaker lens 28.

A first mass resolving quadruple rod set Q1 is provided in the chamber 26 for mass selection of a precursor ion. Following the rod set Q1, there is a collision cell 30 containing a second quadruple rod set Q2, and following the collision cell 30, there is a third quadruple rod set Q3 for effecting a second mass analysis step.

The final or third quadruple rod set Q3 is located in the main quadruple chamber 26 and subjected to the pressure therein typically $1\times10^{-5}$ Torr. As indicated, the second quadruple rod set Q2 is contained within an enclosure forming the collision cell 30, so that it can be maintained at a higher pressure. As one skilled in the art will appreciate, this pressure is analyte dependent and could be, for example, 5 mTorr. Interquad barriers or lens IQ2 and IQ3 are provided at either end of the enclosure of the collision cell of 30.

Ions leaving Q3 pass through an exit lens 32 to a detector 34. It will be understood by those skilled in the art that the representation of FIG. 1 is schematic, and various additional elements would be provided to complete the apparatus. For example, a variety of power supplies are required for delivering AC and DC voltages to different elements of the apparatus. In addition, a pumping arrangement or scheme is required to maintain the pressures at the desired levels mentioned.

As indicated, a power supply 36 is provided for supplying RF and DC resolving voltages to the first quadruple rod set Q1. Similarly, a second power supply 38 is provided for supplying drive RF and auxiliary AC voltages to the third quadruple rod set Q3, for scanning ions axially out of the rod set Q3. A collision gas is supplied, as indicated at 40, to the collision cell.

In this embodiment, the third quadruple rod set Q3 is modified to act as a linear ion trap mass spectrometer with the ability to effect axial scanning and ejection, utilizing an auxiliary dipolar AC voltage (not shown in FIG. 1) to effect ion ejection. The instrument retains the capability to be operated as a conventional triple quadruple mass spectrometer.

A standard scan function, detailed in U.S. Pat. No. 6,177,668, involves operating Q3 as a linear ion trap. Analyte ions are admitted into Q3, trapped and cooled. Then, the ions are mass selectively scanned out through the exit lens 32 to the detector 34. Ions are ejected when their radial secular frequency matches that of a dipolar auxiliary AC signal applied to the rod set Q3 due to the coupling of the radial and axial ion motion in the exit fringing field of the linear ion trap Ion ejection in the direction normal to the axis of the linear ion trap can also be effected as taught by U.S. Pat. No, 5,420,425. Trapped ions may also be ejected by means of an auxiliary voltage applied in a quadrupolar fashion or without any auxiliary voltage by utilizing a stability boundary at q~0.907. Trapped ions may also be detected in situ as taught by U.S. Pat. No. 4,755,670.

In the example of an enhanced product ion (EPI) scan performed over a wide m/z range, a parsing algorithm is used. This parsing algorithm splits the m/z range into narrower m/z windows. In an exemplary EPI scan, if a scan of the fragments of a 922 Da single charge precursor ion is performed, and the m/z range is between 150 Da and 925 Da, the algorithm can, e.g., divide the scan into two separate scan windows: the first scan window from 150 Da to 468 Da and the second scan window from 468 Da to 925 Da. The ions fill the ion trap Q3 and are cooled. In each scan window, the fragment ions are scanned out of the ion trap Q3 and detected. In the first scan window, only fragment ions of m/z between 150 Da to 468 Da are scanned out. However, fragment ions of m/z larger than 468 Da are also present in the ion trap Q3, which can lead to deterioration of the analytical spectra. The interference that is exhibited as a result of space charge, whereby the mass spectrum obtained from the trapped ions becomes distorted.

Figure 2:
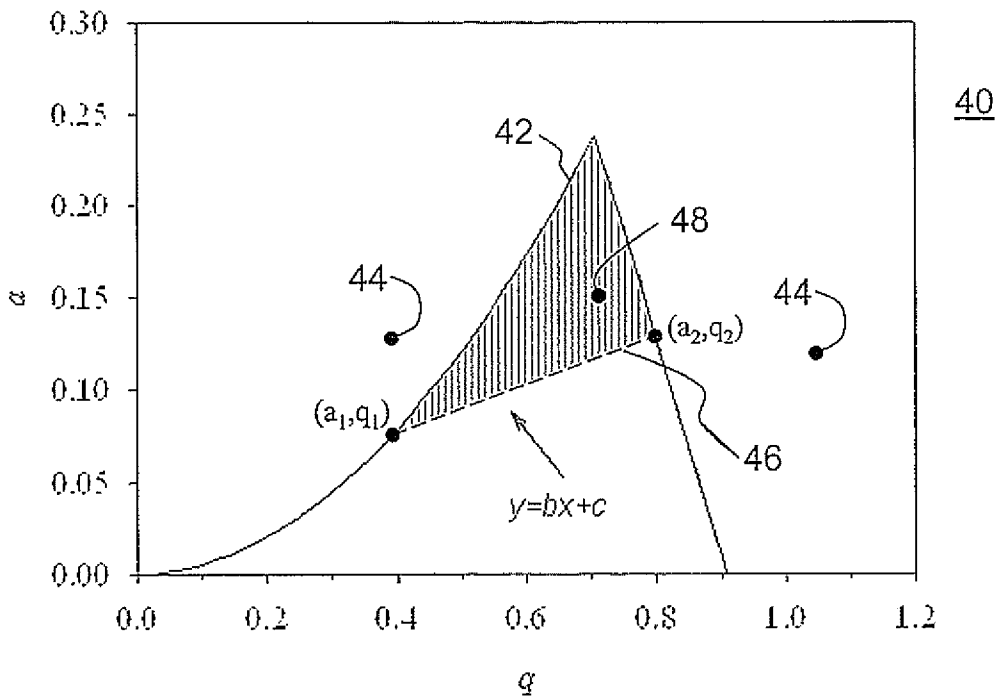
FIG. 2 is an exemplary stability diagram illustrating the stability of fragmented ions in the linear ion trap of FIG. 1.

FIG. 2 depicts a typical stability diagram generally referenced by the numeral 40. In this example, the stability curve 42, is plotted for a certain m/z. As a person skilled in the art will understand, the area inside the boundaries 42 represents voltages where fragmented ions will have stable trajectories, and the area outside the boundaries 44 represents voltages where fragmented ions will have unstable trajectories. Ions having unstable trajectories are neutralized by striking the quadrupole electrodes of the ion trap Q3.

Scan line 46 depends on the selected mass range and is represented by the equation y=bx+c. Intersection points ($a_1$, $q_1$) and ($a_2$, $q_2$) determine the minimum and maximum m/z of the mass range of ions that are stable in the Q3 when a certain RF and DC are applied on the rods of the quadrupole. In this example, the scan line 46 is for a mass window range from 200 to 500 Da. The parameters a and q are defined by the Mathieu equations:

$$a = \frac{8eU}{mr_0^2\Omega^2} \text{ and } q = \frac{4eV}{mr_0^2\Omega^2}$$

where m is the mass, $r_0$ is the field radius of the quadrupole, and Ω is the angular drive frequency of the quadrupole, U is the resolving DC measured pole to ground and V is the RF amplitude measured pole to ground.

The variables U and V set up the quadrupole to allow transmission or isolation of a large mass window. The slope b of the scan line 46 is determined by:

$$b = \frac{a_1}{q_1} = \frac{a_2}{q_2} = \frac{2U}{qV}$$

The centre of the mass window is determined by:

$$m_c = \frac{m_1 + m_2}{2} = \frac{2eV}{r_0^2\Omega^2}\left(\frac{q_1 + q_2}{q_1 q_2}\right)$$

The position of the scan line 46 shown in FIG. 2 depends on the width and position of the window. The same scan line 46 will give a wider window for higher masses than it would for lower masses. Therefore a relationship between the width of the window and the position of the window is used for the calculation of U and V. The relationship chosen for the example in FIG. 2 is the ratio of the window width to the center of the window. For the scan line 46 of FIG. 2 the window is 300 Da wide centered at 350 Da giving a ratio of 0.85714.

From the stability diagram, for any set of U and V, one can determine whether ions of a certain m/z have stable trajectories. For example, at a certain ink, an RF voltage and resolving DC voltage is applied to the ion trap Q3 in a quadrupolar manner, the ratio of which lie on a scan line 46. Fragmented ions having m/z inside area bounded by the scan line 46 and the stability curve 42 create a stable range 48 where fragmented ion trajectories will remain stable. All other fragmented ions outside the stable range 48 will become unstable and be axially ejected from Q3.

Figure 3:
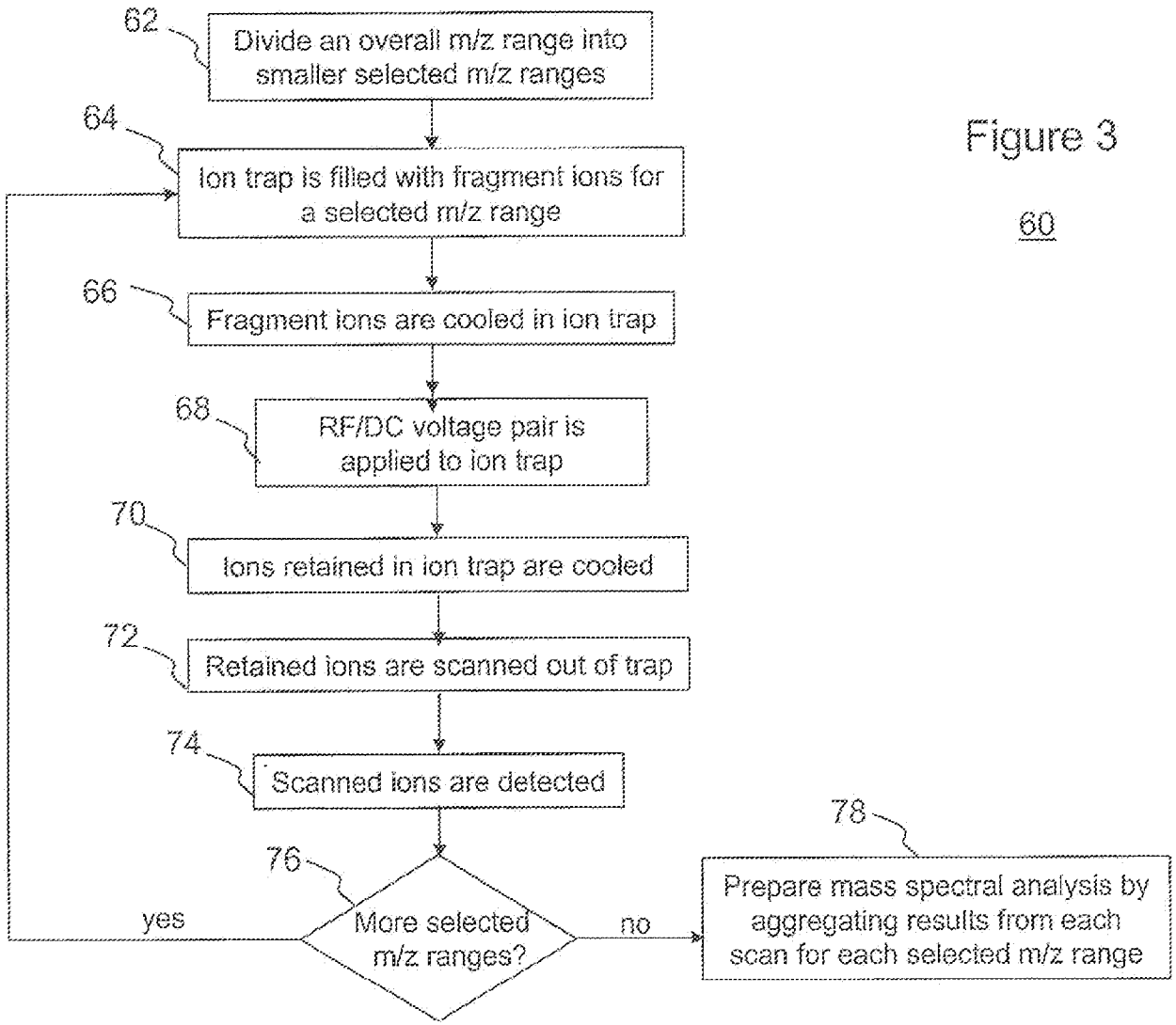
FIG. 3 is a flow diagram depicting an exemplary method of applying a resolving DC voltage to an ion trap to eliminate fragment ions with unstable trajectories in FIG. 2.

FIG. 3 is a flow diagram depicting a method of reducing space charge generally referenced by numeral 60. In step 62 an overall ion m/z range is chosen for analyzing and divided into smaller selected m/z ranges. The selected m/z ranges are divided such that when amassed form the overall m/z range. In step 64, the ion trap is filled with fragmented ions of one of the selected ion mass-to-charge (m/z) range for analyzing. In step 66, the fragmented ions are cooled in the ion trap typically through collisions with buffer gas, for a cooling period determined by the collision rate and the pressure in the ion trap. In step 68, an RF voltage and a resolving DC voltage are applied to the ion trap quadrupolarly to eliminate fragmented ions outside the desired m/z range. As the RF voltage and resolving DC voltage are applied, fragmented ions having an m/z larger or smaller than the desired m/z range will become unstable and have unstable trajectories. Referring to FIG. 2, the RF voltage and resolving DC voltage that cause these unstable trajectories fall in the range 48.

Returning to the method in FIG. 3, in step 70, the fragmented ions that are retained in the trap are allowed to cool by collisions with a buffer gas for another cooling period determined by the collision rate and the pressure in the ion trap. In step 72, the retained ion fragments are scanned out of the ion trap by using mass selective axial ejection as described in U.S. Pat. No. 6,177,668. In step 74, the ions released from the trap are detected by a detector such as an electrode multiplier or any other ion detector. If in step 76, there are more selected m/z ranges to analyze, then the method returns to step 64 and the ion trap is filled for the next selected m/z range. If in step 76, there are no more m/z ranges to analyze, then a mass spectra analysis for the overall ion m/z range is prepared by aggregating the results from each scan for each selected m/z range.

A typical cooling period time for the first cooling period can be 20 ms. The first cooling time period can be reduced to 10 ms or less especially for lower mass range. For higher pressures in the ion trap, shorter times are required to cool the ions before isolation. If the first cooling time is too short, the fragmented ions are not cooled to the bottom of the pseudo-potential well created by the quadrupole RF field. That is, close to the quadrupole axis, some of the fragmented ions that are supposed to have stable trajectories become unstable and are lost on the rods, resulting in a drop in sensitivity.

Similarly, a typical cooling period time for the second cooling period can be 50 ms, which can be reduced to 20 ms or less. Again, For higher pressures in the ion trap, shorter times are required to cool the fragmented ions before isolation. Thus, the lighter the fragmented ions, the shorter the time required to cool the ions.

FIGS. 4A to 4D are mass spectra diagrams obtained from experiments performed during an EPI scan for 922 Da ions. In these exemplary experiments, the EPT window was set between 480 Da and 925 Da. Spectra were acquired for two different ion trap fill times to compare the effects of space charge. The longer ion trap fill time will create a larger ion population with the ion trap and have a higher space charge than the smaller ion population created by a shorter ion trap fill time.

The scans were parsed into two mass-to-charge windows and the results obtained from both scans were aggregated to obtain an overall spectrum. In these exemplary experiments, the first window was 480 Da to 600 Da and the second window was 600 Da to 925 Da. When a quadrupolar resolving DC voltage is applied to the ion trap, fragment ions having an m/z higher than 600 Da are eliminated from the ion trap before the scan of the retained ions.

Figures 4A, 4B, 4C, 4D:
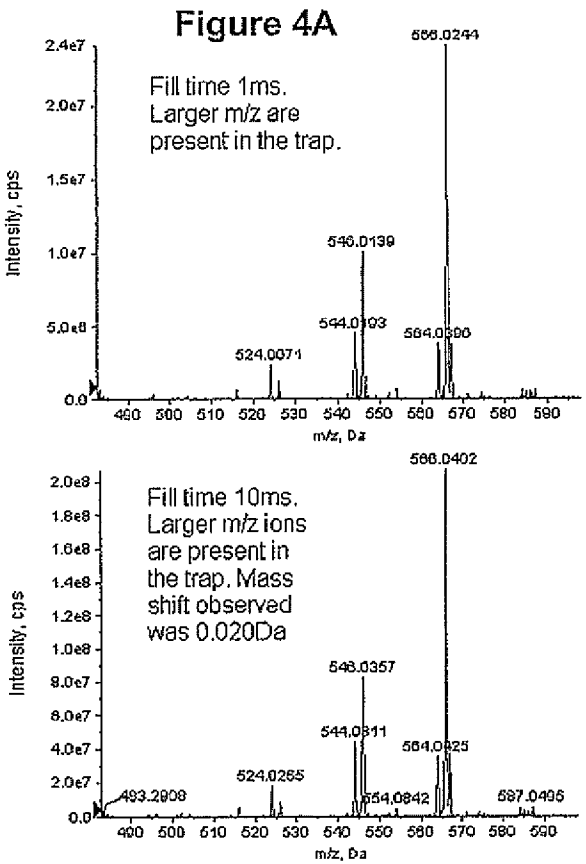
FIGS. 4A-4D are exemplary mass spectra diagrams illustrating the results of scans using the method depicted in FIG. 3.

FIG. 4A shows a spectrum obtained for the first window for an ion trap fill time of 1 ms, during which no resolving DC voltage is applied to the ion trap. FIG. 4B shows a spectrum obtained for the first window for an ion trap fill time of 1 ms where a resolving DC voltage is applied to the trap before the scan is performed.

FIG. 4C shows a spectrum obtained for the first window for an ion trap fill time of 10 ms, during which no resolving DC voltage is applied to the ion trap. FIG. 4D shows a spectrum obtained for the first window for an ion trap fill time of 10 ms where a resolving DC voltage is applied to the trap before the scan is performed.

As one skilled in the art can appreciate, the results presented in FIGS. 4A-4D demonstrate that space charge is reduced when a DC voltage is applied to the trap before the scan is performed.

In the above embodiments, the mass spectrometer structure example used had a structure of: resolving quadruple rod set Q1, a collision cell 30 containing a second quadruple rod set Q2, and following the collision cell 30, a third quadruple rod set Q3 for effecting a second mass analysis step, where Q3 is configured as a linear ion trap. In an alternate embodiment, the mass spectrometer can be configured to have a double quadrupole configuration. In this configuration, there is a first and second quadrupole rod sets. The first quadrupole rod set is configured as mass filter and the second quadrupole rod set is configured as a collision cell for fragmenting ions. After fragmenting within the collision cell, the mass spectrometer is configured such that fragmented ions returning to the first quadrupole rod set which is reconfigured as a linear ion trap where the resolving DC voltage would be applied and then the remaining ions would be scanned and detected therefrom.

All literature and similar material cited in this application, including, but not limited to, patents, patent applications, articles, books, treatises, and web pages, regardless of the format of such literature and similar materials, are expressly incorporated by reference in their entirety. In the event that one or more of the incorporated literature and similar materials differs from or contradicts this application, including but not limited to defined terms, term usage, described techniques, or the like, this application controls.

While the applicants' teachings have been particularly shown and described with reference to specific illustrative embodiments, it should be understood that various changes in form and detail can be made without departing from the spirit and scope of the teachings. Therefore, all embodiments that come within the scope and spirit of the teachings, and equivalents thereto, are claimed. The descriptions and diagrams of the methods of the applicants' teachings should not be read as limited to the described order of elements unless stated to that effect.

While the applicants' teachings have been described in conjunction with various embodiments and examples, it is not intended that the applicants' teachings be limited to such embodiments or examples. On the contrary, the applicants' teachings encompass various alternatives, modifications, and equivalents, as will be appreciated by those of skill in the art, and all such modifications or variations and those of skill in the art will appreciate that further variations and modifications may be made without departing from the spirit and scope thereof as defined by the appended claims.

The invention claimed is:

1. A method for operating a mass spectrometer for a plurality of selected mass-to-charge ranges, the mass spectrometer having an ion trap, the plurality of selected mass-to-charge ranges constituting an overall mass-to-charge range, for each of the plurality of selected mass-to-charge ranges the method comprising:

filling the ion trap with fragmented ions of the selected mass-to-charge ranges;

cooling the fragmented ions trapped in the ion trap for a first cooling period;

applying an RF voltage and a resolving direct current voltage to the ion trap for eliminating any remaining fragmented ions outside the selected ion mass-to-charge range and retaining ions within the selected ion mass-to-charge range;

cooling the retained ions in the ion trap for a second cooling period; and scanning the retained ions out of the ion trap and detecting the ions released therefrom.

2. The method of claim 1, wherein the resolving direct current voltage for each of the plurality of mass-to-charge windows has a value dependent on the selected ion mass-to-charge range of each of the plurality of mass-to-charge windows.

3. The method of claim 2, wherein the value of the resolving direct current voltage for each of the plurality of mass-to-charge windows is determined for destabilizing fragmented ions outside than the selected ion mass-to-charge range for each of the plurality of mass-to-charge windows.

4. The method of claim 1, wherein the values of the RF voltage are selected to destabilize fragmented ions having m/z values outside the desired ion mass-to charge range.

5. The method of claim 1, wherein the mass spectrometer has a triple quadrupole configuration having a first, second, and third quadrupole rod sets, the third quadrupole rod set configured as an ion trap.

6. The method of claim 1, wherein the mass spectrometer has a double quadrupole configuration having a first and second quadrupole rod sets, the first quadrupole rod set configured as mass filter, the second quadrupole rod set configured as a collision cell for fragmenting ions, after fragmenting, fragmented ions returning to the first quadrupole rod set reconfigured as an ion trap.

7. The method of claim 1, wherein mass spectra are obtained from the scanning steps of each of the plurality of mass-to-charge windows.

8. The method of claim 7, wherein an overall mass spectrum is obtained for the overall mass-to-charge range by adding the mass spectra obtained from the scanning steps of each of the plurality of mass-to-charge windows.

* * * * *